United States Patent [19]

Nickel et al.

[11] 4,326,638

[45] Apr. 27, 1982

[54] COMBINATION BASE CUP AND BOTTLE

[75] Inventors: Gerhard E. B. Nickel, Farmington Hills, Mich.; Richard C. Darr, Medina, Ohio

[73] Assignee: Plastipak Packaging Division, Beatrice Food Co., Chicago, Ill.

[21] Appl. No.: 150,247

[22] Filed: May 16, 1980

[51] Int. Cl.[3] ..... B65D 23/08

[52] U.S. Cl. ..... 215/12 R

[58] Field of Search ..... 215/12 R, 1 C, 100 R; 220/69

[56] References Cited

U.S. PATENT DOCUMENTS 4,138,026 2/1979 Conklin ..... 215/12 R 4,241,839 12/1980 Alberghini ..... 215/12 R X

*Primary Examiner*—Donald F. Norton

*Attorney, Agent, or Firm*—Whittemore, Hulbert & Belknap

[57] ABSTRACT

A bottle formed of a flexible plastics material such as biaxially oriented polyethylene terephthalate having a convex, generally rounded bottom incapable of supporting the bottle in a stable, upright position, and a flexible snap-on supporting cup applied to the bottom of the bottle. The base of the cup has a support surface for supporting the bottle in a stable, upright position.

5 Claims, 4 Drawing Figures

COMBINATION BASE CUP AND BOTTLE

This invention relates generally to a bottle having a base cup applied to the bottom to support it in a stable, upright position.

BACKGROUND AND SUMMARY OF THE INVENTION

Bottles of flexible plastics material, such as biaxially oriented polyethylene terephthalate (PET), are coming into favor because they are lighter in weight and more resistant to breakage due to shock or impact than bottles made of glass. However, these PET bottles, when formed by injection blow molding, have bottoms which are unavoidably convex or rounded and are therefore incapable of standing in a stable, upright position. The principle object of this invention is to provide a supporting base cup for application to the bottom of the bottle which snaps on readily and will stay on despite normal and even excessively abnormal handling, or being dropped on a hard surface or otherwise subjected to heavy shock or impact. The cup and also the bottom of the bottle are specially formed to hold the cup firmly applied, without the need for an adhesive.

Other objects and features of the invention will become more apparent as the following description proceeds, especially when considered in conjunction with the accompanying drawings.

DETAILED DESCRIPTION

Figure 1:
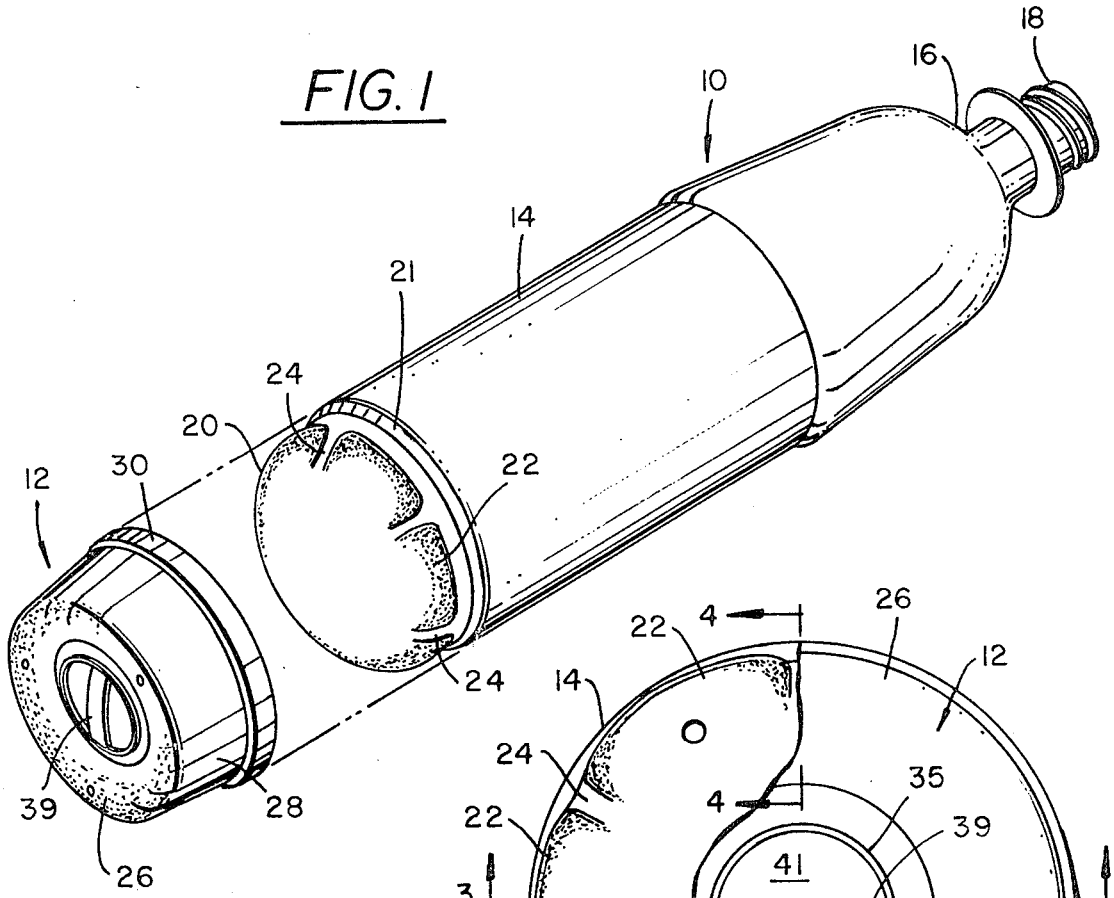
FIG. 1 is a perspective view of a bottle having a base cup applied to the bottom, constructed in accordance with the invention.
Figure 2:
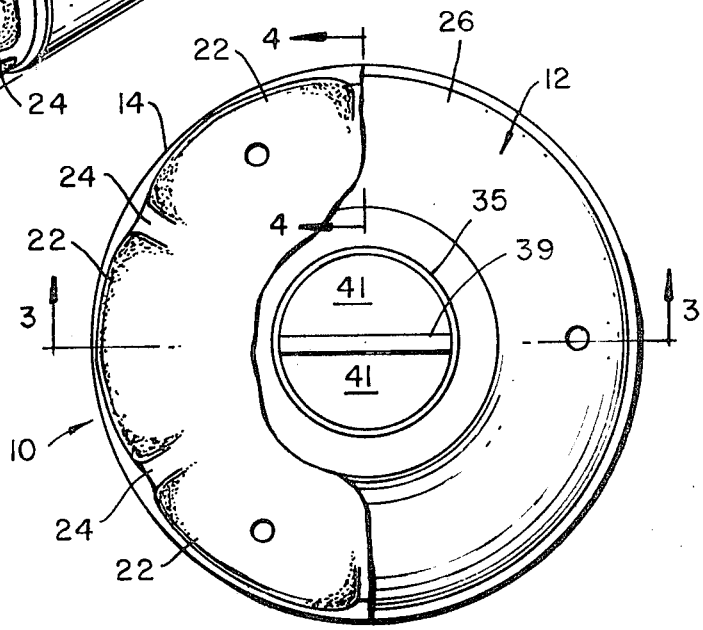
FIG. 2 is a bottom plan view, with parts broken away, of the bottle and base cup of FIG. 1.
Figure 3:
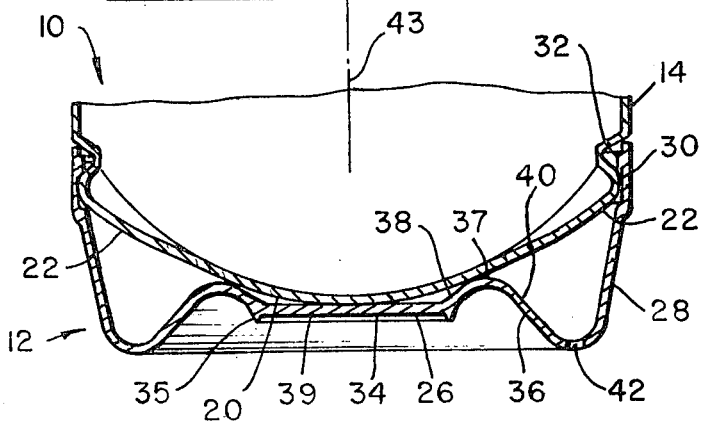
FIG. 3 is a fragmentary sectional view taken on the line 3—3 of FIG. 2.
Figure 4:
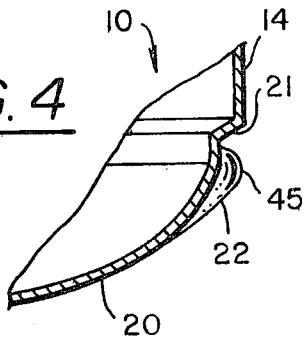
FIG. 4 is a fragmentary sectional view taken on the line 4—4 of FIG. 2.

Referring now more particularly to the drawings, the bottle is generally designated 10 and the base cup 12. The bottle is usually made of a suitable flexible plastics material, and preferably is injection blow-molded from biaxially oriented polyethylene terephthalate (PET). The base cup is usually made of a suitable flexible, resilient plastics material, preferably polyethylene.

The bottle 10 is a typical fluid container which may be used for any suitable product such as a soft drink. It has a cylindrical side wall 14 formed at the top with a neck 16 terminating in a pouring spout 18 adapted to be closed and sealed by a cap. The bottom 20 has the convex rounded configuration shown which is such that the bottle is incapable of standing alone in a stable, upright position. The bottom 20 of the bottle is smaller in diameter than the side wall 14 and is connected to the side wall by a downwardly and inwardly slanted annular portion 21.

The bottom 20 is spherical except for the angularly spaced bulged portions 22 which project outwardly from the otherwise spherical configuration. These bulged portions are near the radially outer extremity of the bottom 20 and are separated from one another by intervening portions 24 which constitute continuations of the spherical form. These intervening portions 24 in effect provide straps which resist pressure in the bottle that otherwise may tend to flatten the bulged portions. It is well known that bottles of this type are often placed under internal pressure. Such pressure may be on the order of approximately four atmospheres. It is not unusual for these bottles to be capable of withstanding internal pressures up to 120 psi.

The cup 12 has a base 26 which when, the cup is applied to the bottom of the bottle as shown, extends across the bottom 20. The cup also has a surrounding annular side wall 28. The side wall 28, in the natural free state condition of the cup, flares outwardly somewhat in a direction away from the base and terminates in a generally cylindrical rim 30 which has an annular rib 32 on its inner surface. The inside diameter of rib 32, in the free state condition of the cup, is less than the diameter of a circle drawn at right angles to the central axis 43 of the cup and circumscribing the bulged portions 22 at the points 45 of maximum lateral displacement from the central axis 43.

The base 26 of the cup has a raised central portion 34 and an annular portion 36 connecting the central portion to the side wall 28. The central portion 34 consists of a ring 35 and a diametral bar 39 extending across the ring to define an opening 41 on either side of the bar. The annular portion 36 is generally S-shaped in cross section, having an inner upwardly flaring part 38 extending from the central portion 34. Part 38 connects in a curve 37 to the downwardly flared intermediate part 40 which in turn extends into a curved outer part 42 that emerges into side wall 28. This curved outer part 42 of the annular portion 36 lies in a plane extending at right angles to the central axis 43 of the cup to provide a supporting surface.

The cup 12 snaps on the bottle in the position shown in the drawings by simple endwise pressure sufficient to cause the side wall 28 to expand and the rib 32 to cam over the bulged portions 22 into firm engagement therewith above points 45 thereof. In this assembled position, the side wall 28 of the cup is slightly expanded, drawing the central part 34 of the base 26 into firm contact with the bottom 20 of the bottle. The part 42 provides a flat circular base capable of supporting the bottle in a stable, upright position.

The stretched condition of the applied base cup, in which the central portion 34 of the base 26 of the cup presses against the bottom 20 of the bottle and thereby draws the side wall 28 inwardly, causes the rib 32 to be held in contact with the bulged portions 22 above points 45 thereof under resilient pressure. Internal pressure in the bottle which tends to distend the bottom of the bottle causes it to press with even greater force against the central part 34 of the base. Such downward force on the central part 34 of the base adds a further pressure tending to draw the side wall inwardly and enhance the pressure contact of the rib with the outwardly bulged portions.

The intervening portions 24 between the bulged portions 22, as previously stated, constitute straps which resist the internal pressure in the bottle which otherwise might tend to flatten the bulged portions. It is desirable that the bulged portions retain their full configuration as shown so as to prevent the rib 32 from accidentally camming over the bulged portions and the cup becoming separated from the bottle. The cup and bottle combination as shown and described will remain assembled without separation and without the use of an adhesive despite normal and even abnormal handling.

We claim:

1. In combination, a bottle having a generally convex, rounded bottom incapable of supporting the bottle in a stable, upright position, and a supporting cup applied to the bottom of said bottle, said bottom having angularly spaced, laterally outwardly bulged portions, said cup having a base extending across the bottom of said bottle and an annular side wall projecting upwardly from said base and surrounding said outwardly bulged portions, said side wall having detent means engaging over said outwardly bulged portions to retain said cup on the bottom of said bottle, the portions of said bottom between said bulged portions providing straps to resist the tendency of said bulged portions to become flattened due to pressure in said bottle, the base of said cup providing a support surface for supporting said bottle in a stable, upright position.

2. The combination defined in claim 1, said detent means comprising an annular rib on the inner surface of the side wall of said cup.

3. The combination defined in claim 2, wherein said cup is formed of flexible, resilient plastics material, said base has an outer annular portion joined to said side wall and a central portion raised relative to said annular portion and in pressure contact with said bottom of said bottle, the pressure contact of said central portion of said cup with the bottom of said bottle drawing said side wall inwardly resulting in more firm engagement of said rib with said outwardly bulged portions.

4. The combination defined in claims 1, 2 or 3, wherein said bottom of said bottle is generally spherical except for said outwardly bulged portions thereof, said straps providing continuations of the generally spherical form of said bottom.

5. The combination defined in claim 4, wherein said bottle is made of biaxially oriented polyethylene terephthalate.

* * * * *